United States Patent [19]

Lodge et al.

[11] Patent Number: 4,777,779

[45] Date of Patent: Oct. 18, 1988

[54] PIPET PLUGGING MACHINE

[75] Inventors: Daniel A. Lodge, Bridgeton; Donald D. Wheeler, Landisville, both of N.J.

[73] Assignee: Meteor Manufacturing & Machinery Co., Vineland, N.J.

[21] Appl. No.: 525,496

[22] Filed: Aug. 22, 1983

[51] Int. Cl.[4] ..... B65B 61/22; B65B 63/04

[52] U.S. Cl. ..... 53/115; 53/319

[58] Field of Search ..... 53/115, 238, 264, 319; 226/153

[56] References Cited

U.S. PATENT DOCUMENTS

| | | | |
|---|---|---|---|
| 334,909 | 1/1886 | Thompson | 226/153 |
| 2,004,129 | 6/1935 | Potdevin | 226/153 |
| 3,121,985 | 2/1964 | Harrison | 53/115 |
| 3,157,012 | 11/1964 | Shellman et al. | 53/115 |
| 3,460,315 | 8/1969 | Roeck | 53/115 |
| 3,969,873 | 7/1976 | Klar | 53/234 |

FOREIGN PATENT DOCUMENTS

| | | | |
|---|---|---|---|
| 832752 | 4/1960 | United Kingdom | 53/115 |
| 1031924 | 6/1966 | United Kingdom | 53/115 |

*Primary Examiner*—Horace M. Culver
*Assistant Examiner*—Donald R. Studebaker
*Attorney, Agent, or Firm*—Brady, O'Boyle & Gates

[57] ABSTRACT

A compact self-contained machine operated by a single gear motor and having start and stop cycle switches feeds a cotton roving and severs the roving into plugging lengths. The severed plugging lengths are folded and inserted as plugs into the mouths of pipets which are held one at a time by hand in a locator bushing on a cycle activating panel of the machine.

1 Claim, 4 Drawing Sheets

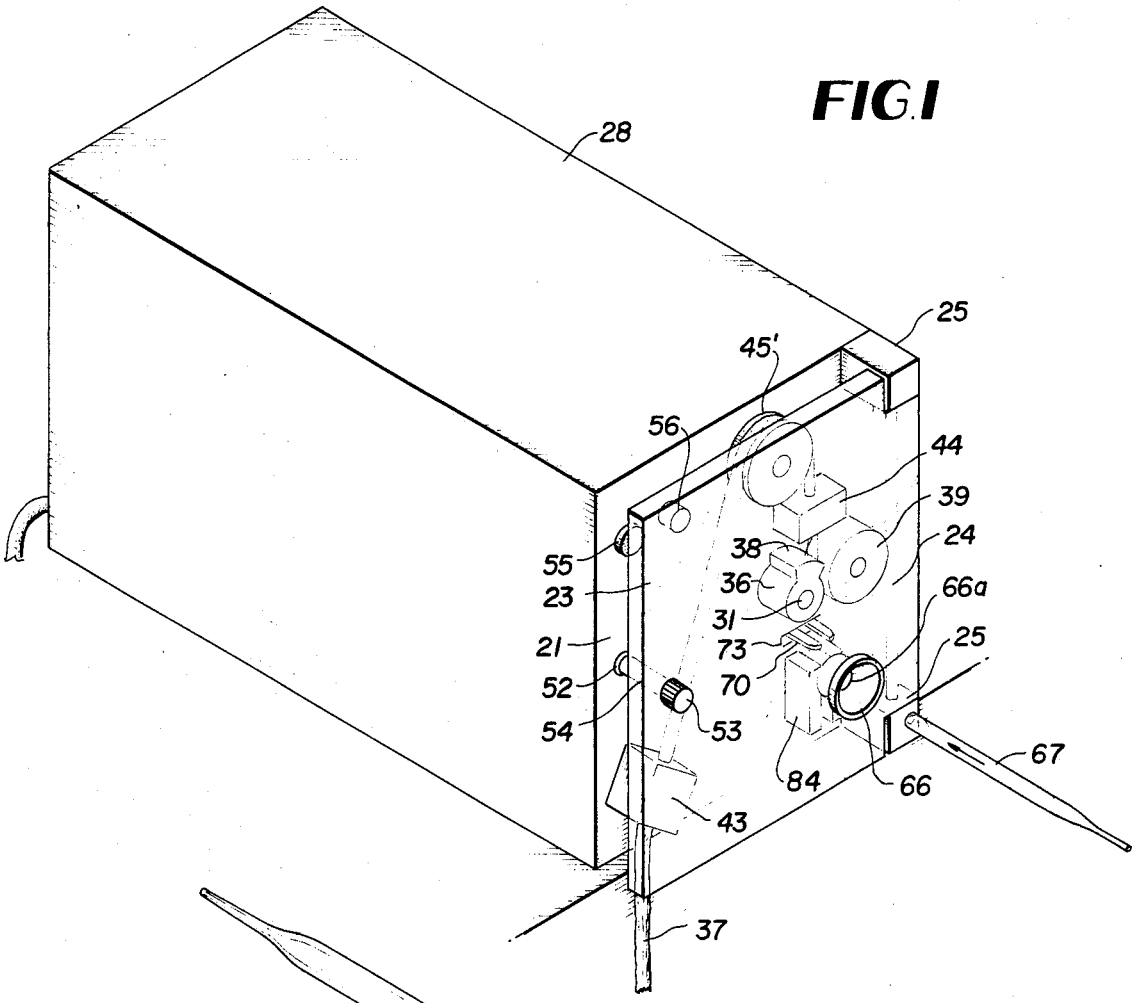
FIG. 1
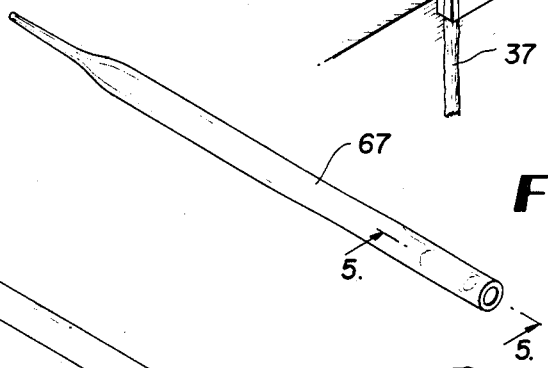
FIG. 2
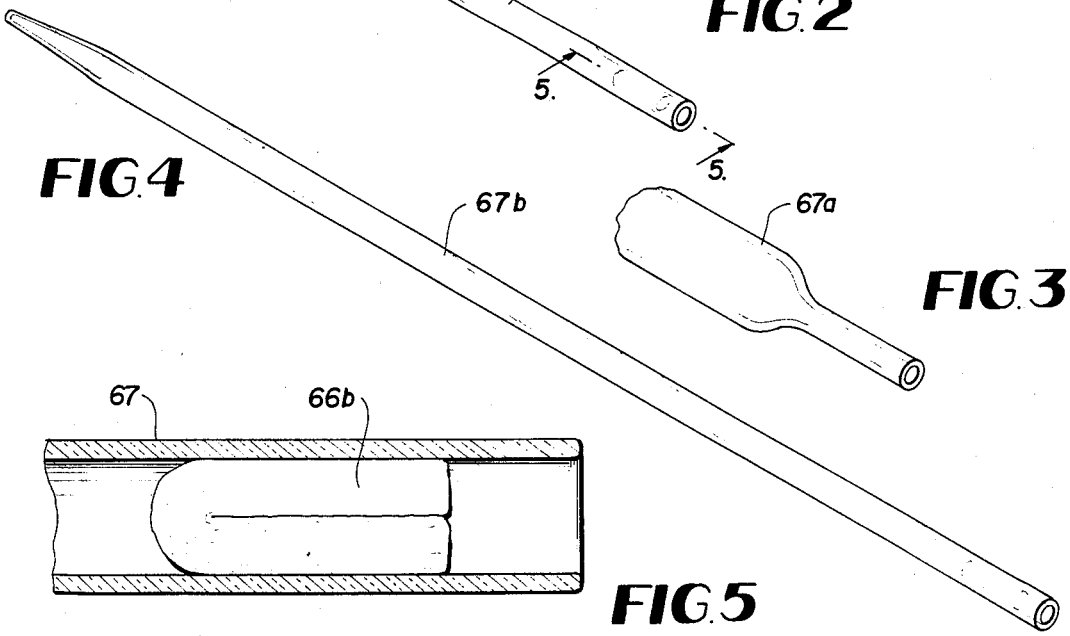
FIG. 4
FIG. 3
FIG. 5

FIG. 6
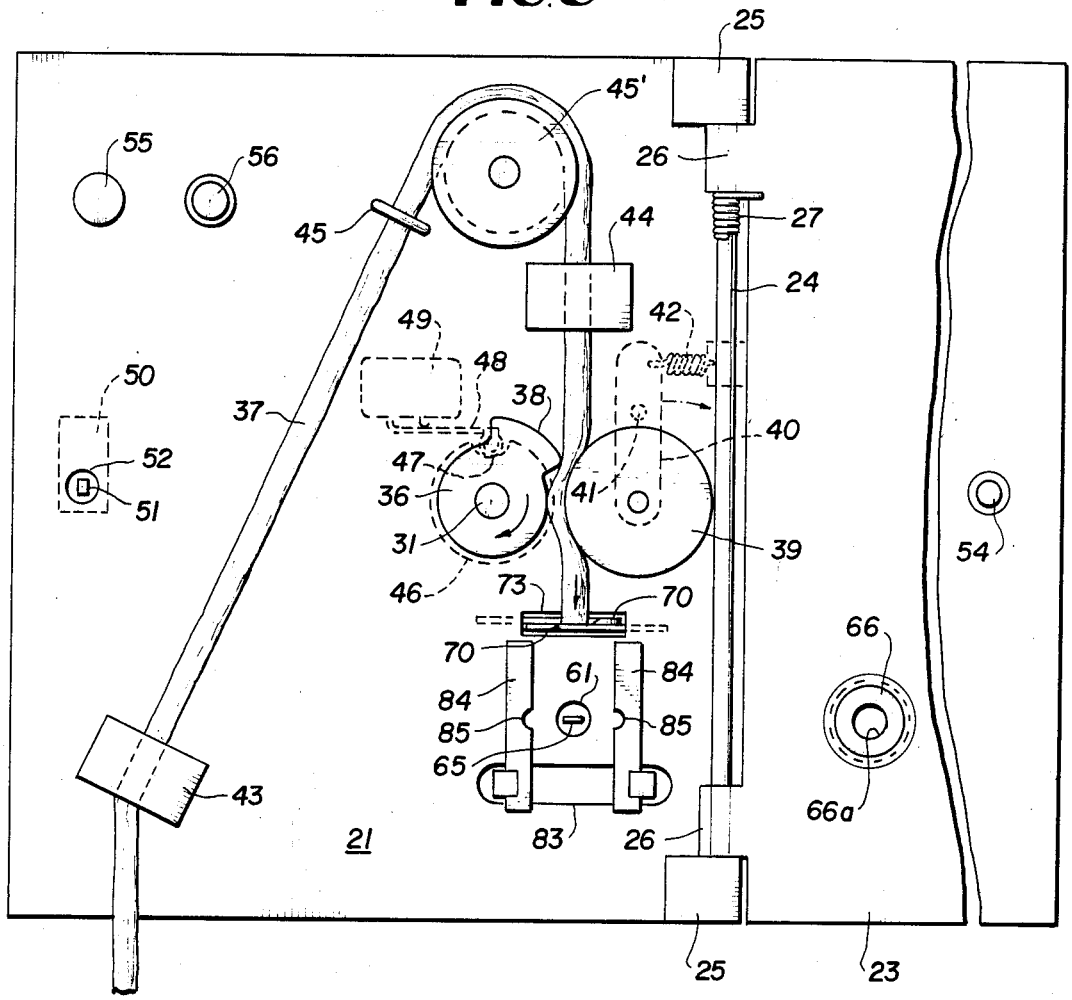
FIG. 8
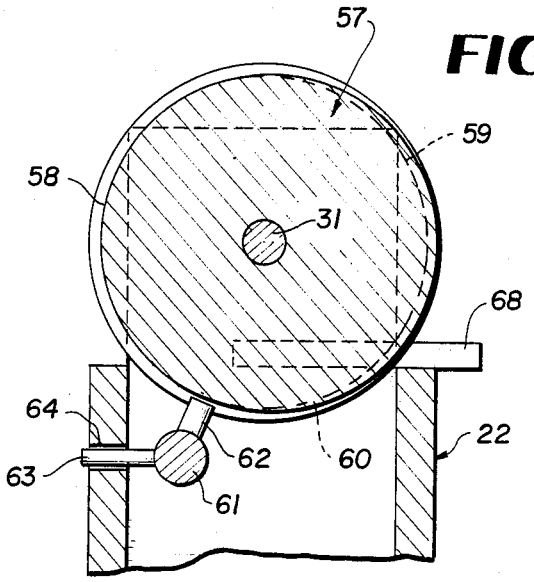
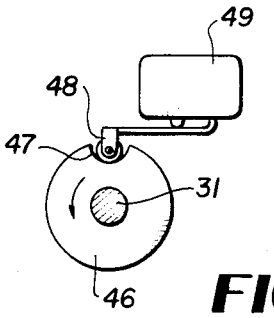
FIG. 9

FIG.10
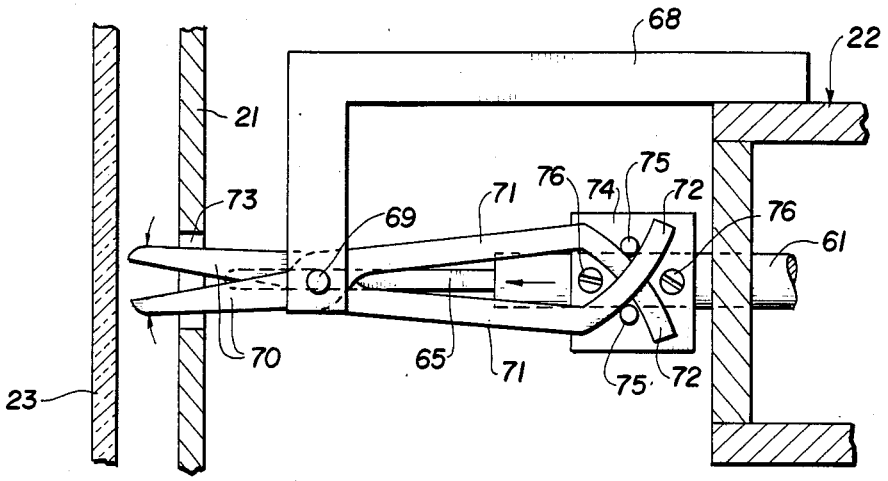
FIG.11
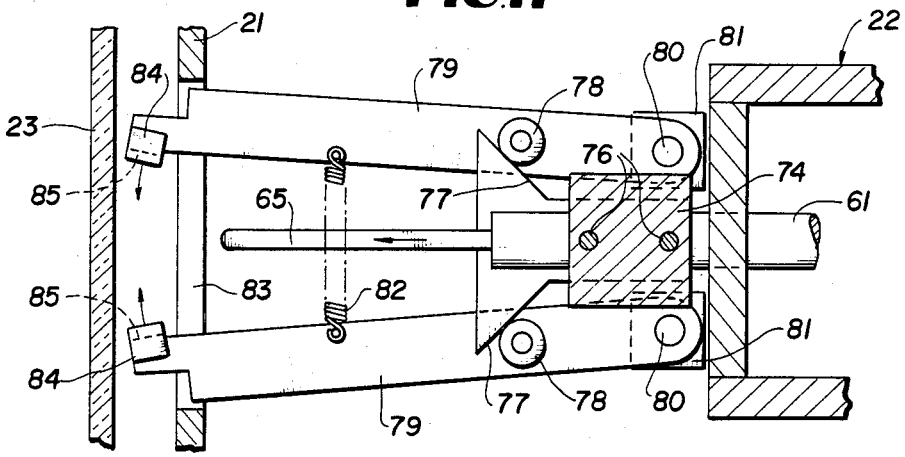
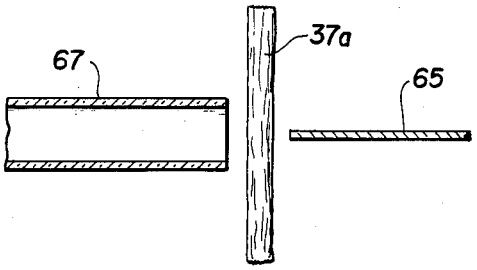
FIG.12
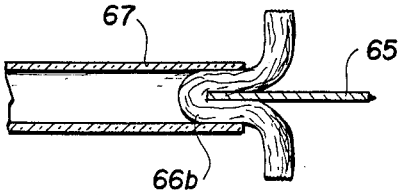
FIG.13

PIPET PLUGGING MACHINE

BACKGROUND OF THE INVENTION

The simple objective of this invention is to provide a simpler, more compact and more reliable machine for inserting cotton plugs into the mouths of pipets.

Machines for this purpose are well known in the art, as exemplified by U.S. Pat. Nos. 3,121,985, Harrison, and 3,460,315, Roeck. The present invention is an improvement on the prior art machines in that fewer parts and a generally simpler operating mechanism are employed for accomplishing the objective of inserting cotton plugs into the mouths of pipets in a uniform and reliable manner, rapidly, and with virtually no manual effort required on the part of the machine operator. The machine is completely insensitive to variations in the lengths of pipets and in the sizes of their bodies, while taking advantage of the fact that the rear openings of most pipets are of a standard size.

Various features and advantages of the invention will be readily apparent to those skilled in the art during the course of the following detailed description.

BRIEF DESCRIPTION OF THE DRAWINGS

FIG. 1 is a perspective view of a pipet plugging machine according to the present invention.

FIG. 2 is a perspective view of one form of pipet which can be plugged by the machine.

FIGS. 3 and 4 are perspective views of other forms of pipets which the machine can plug.

FIG. 5 is an enlarged fragmentary vertical section taken on line 5—5 of FIG. 2 and showing a cotton plug placed in the rear end of a pipet by the machine.

FIG. 6 is a front end elevation of the machine with its hinged cycle activating panel swung aside for clarity of illustration.

FIG. 8 is a transverse vertical section taken on line 8—8 of FIG. 7.

FIG. 9 is a similar section taken on line 9—9 of FIG. 7.

FIG. 10 is a horizontal section taken on line 10—10 of FIG. 7.

FIG. 11 is a similar section taken on line 11—11 of FIG. 7.

FIGS. 12 and 13 are enlarged fragmentary vertical sections depicting the insertion of a plug into a pipet by the machine.

DETAILED DESCRIPTION

Figure 7:
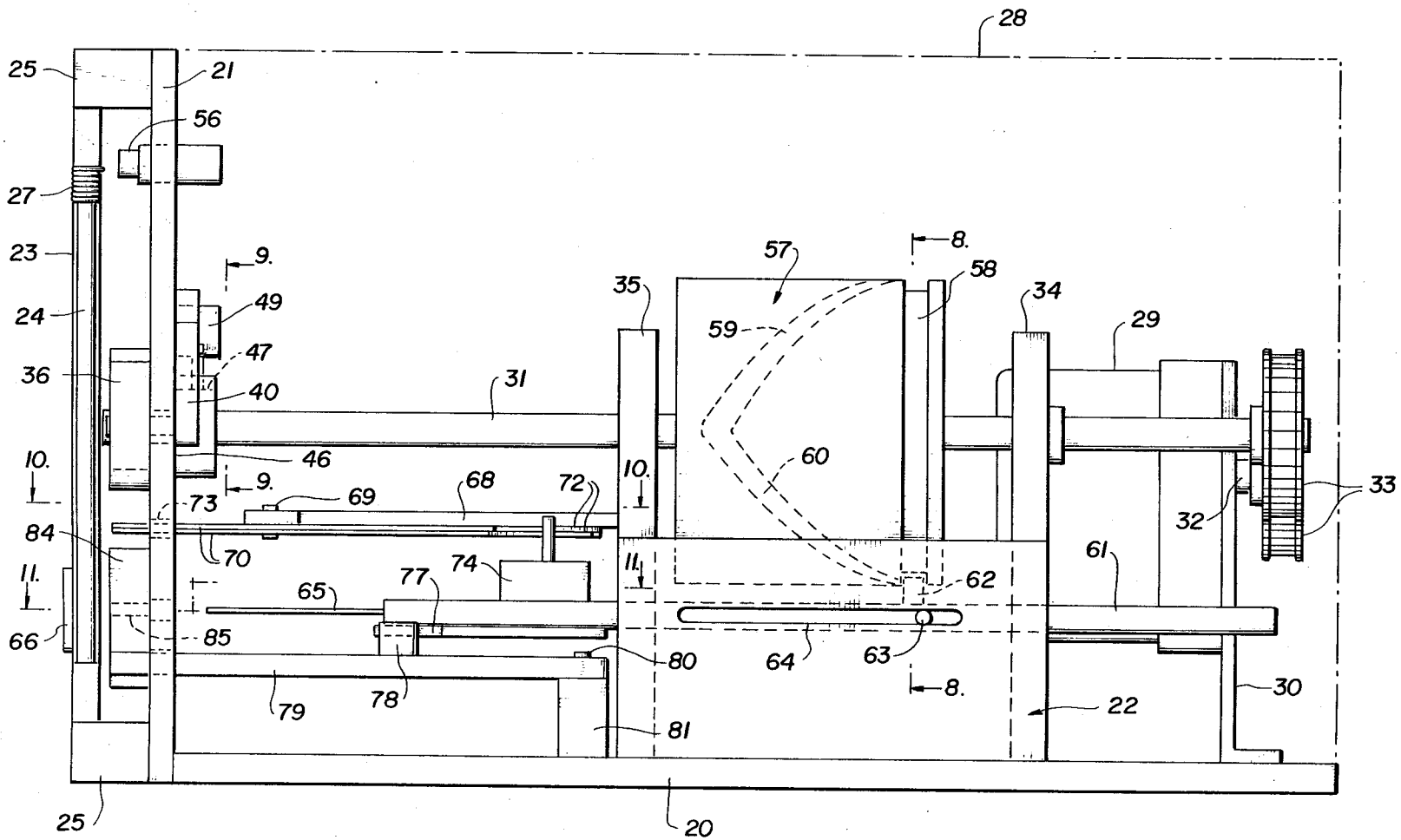
FIG. 7 is a side elevation of the machine with its cover removed for clarity.

Referring to the drawings in detail wherein like numerals designate like parts, a very compact pipet plugging machine depicted in its entirety in FIG. 1 is rectangular in form, measuring approximately 14" long by 6½" wide by 7½" in height. Thus, the machine is about the size of a shoe box.

As best shown in FIG. 7, the frame of the machine includes a flat base plate 20 and a right angular upstanding forward end wall 21 rigidly secured thereto. A box-like sub-frame 22 is fixed on the base plate 20 and rises therefrom intermediate the ends and the opposite sides of the base plate, for purposes to be described.

Somewhat forwardly of the vertical end wall 21, a preferably translucent rectangular operating cycle start-up panel 23 is hinged to the machine by a vertical axis hinge pin 24 adjacent to one side wall of the machine.

The ends of the hinge pin 24 are held in blocks 25 projecting forwardly from the end wall 21. Hinge knuckles 26 on the panel 23 receive the pin 24, and a torsion spring 27 on the pin 24 is employed to bias the panel 23 away from the adjacent vertical end wall 21 slightly.

The machine frame and all of its internal mechanism, yet to be described, are conveniently enclosed by a rectangular sheet metal cover 28 having side and top walls and a rear end wall, but being open at its bottom and forward end.

Near its rear end, the machine includes a single gear motor 29 supported by a bracket 30 secured to the base plate 20. The gear motor 29 is a shaded pole gear motor No. 3M257 sold by Dayton Electric, Chicago, Ill. 60648, or an equivalent motor. The gear motor has a built-in magnetic brake for precise stopping. The gear motor can be operated from any standard 115 volt wall outlet.

A horizontal longitudinal drive shaft 31 extends substanially for the entire length of the machine, FIG. 7, in laterally spaced parallel relationship to the output shaft 32 of gear motor 29. The two shafts 31 and 32 are interconnected by chain and sprocket gearing 33. Support posts 34 and 35 rising from the sub-frame 22 form spaced bearings for the drive shaft 31.

Fixed to the forward end of drive shaft 31 forwardly of the end wall 21 and between it and the panel 23 is a feed wheel 36 for a cotton roving 37 pulled from a source not shown. The feed wheel has a single lobe 38 whose circumferential length determines the length of the roving 37 fed during each cycle of operation of the machine. An opposing idler wheel 39 on one side of the feed wheel 36 and also disposed on the forward side of end wall 21 is supported by a lever 40 on the inner face of the end wall 21 and being pivoted to the end wall as at 41 between its ends. The pivoted lever 40 is biased by a spring 42, FIG. 6, in a direction to hold the idler wheel 39 against the feed wheel 36 so as to grip the cotton roving 37 therebetween. The cotton roving is fed through guides 43, 44 and 45 on the front face of end wall 21, and around a guide sheave 45'.

Immediately rearwardly of the feed wheel 36 and on the interior side of end wall 21 and fixed to drive shaft 31 is a cam 46 having a peripheral recess 47 to receive the actuator element 48 of a cycle terminating microswitch 49, also held on the interior side of end wall 21.

An operating cycle start microswitch 50 having a switch actuator 51 is also mounted on the interior of end wall 21 with the actuator 51 projecting through an aperture 52 formed in the end wall 21. A knob 53 on the hinged panel 23 includes a shank 54 projecting inwardly of the panel 21 to engage the switch actuator 51 at proper times to start the cycle of operation of the machine, as will be further described. Also mounted on the forward end wall 21 is a fuse 55 and a ready light 56 visible through the translucent panel 23.

Fixed on the drive shaft 31 between bearing posts 34 and 35 is a cylindrical rotary cam 57 having an annular groove 58 extending for 180° circumferentially and then extending forwardly in the periphery of the cam on its far side in FIG. 7 at 59 for 90°, and then extending rearwardly at 60 for a final 90° circumferentially, the cam groove so formed being continuous and at the same depth in the periphery of the cylindrical cam 57.

A horizontal longitudinal reciprocatory rod 61 parallel to the drive shaft 31 is supported on the end walls of box-like sub-frame 22. A cam follower pin 62 projects radially from reciprocatory rod 61 and rides in the continuous cam groove composed of groove sections 58, 59 and 60. Another pin 63 projecting radially from the rod 61 extends through a horizontal longitudinal straight guide slot 64 in one side wall of sub-frame 22. During rotation of the cam 57 with drive shaft 31, the rod 61 will have no longitudinal movement during 180° of cam rotation while the follower element 62 is in groove section 58. This is followed by 90° of forward movement of the rod 61 while the follower 62 is in cam groove portion 59, and 90° of rearward movement of the rod 61 while the follower 62 is in the cam groove portion 60.

At its forward end, the reciprocatory rod 61 carries a plug folding and inserting needle 65 which is coaxial with a tapered guide bushing 66 into which the rear open end of each pipet 67, **67*a* or 67*b* requiring plugging is manually placed and stabilized, one pipet at a time. The central aperture of the tapered guide bushing 66 is of smaller diameter than the pipet diameter so that the pipet will not enter the aperture of the bushing, but will merely be seated on the conical surface of the bushing with its bore or mouth in registration with the aperture 66*a* of the bushing in readiness to receive a cotton plug 66*b*. The tapered guide bushing 66 is mounted on the spring-biased hinged panel 23 in spaced relation to the opposing end wall 21, with its aperture 66*a* disposed in axial alignment with the needle 65 and adapted to receive the needle in the process of folding and inserting a plug 66*b*** into the open end of a pipet.

An L-shaped horizontal support bracket 68 fixed to one side wall of sub-frame 22 supports a pivot element 69 for scissors 70 having rearwardly extending arms 71 terminating in curved crossing cam extensions 72. The scissor blades 70 operate through a slot 73 in end wall 21, and projecting into the space between this end wall and the hinged panel 23, FIG. 10, where the cotton roving 37 is being fed intermittently.

On the reciprocatory rod 61 and moving forwardly and rearwardly therewith is a block 74 carrying a pair of laterally spaced upstanding pins 75, which cammingly engage scissor arm extensions 72 to open and close the scissor blades 70 during reciprocation of the rod 61. The block 74 can be secured to the rod 61 by means of screws 76 or by other suitable means. As best shown in FIG. 10, when the rod 61 and inserting needle 65 are advanced forwardly by the rotary cam 57, the scissor blades 70 will close to sever the roving 37, and when the rod 61 is retracted by the cam 57, the scissor blades 70 are automatically opened. The closing and opening of the scissor blades is thus effected by the coordinated action of rotary grooved cam 57 and the pins 75 acting on the curved extensions 72.

Also fixed on the rod 61 at the lower side thereof and near the rear end of the needle 65 is a pair of convergent edge cams 77, FIG. 11, which coact with cylindrical followers 78 held on a pair of clamp arms 79 having their rear ends pivotally secured at 80 to posts 81 on the base plate 20. The clamp arms 79 are biased toward each other by a retractile spring 82, the forward ends of the arms projecting through a clearance slot 83 in the end wall 21 and into the space between the end wall and the panel 23.

In this space, the clamp arms 79 carry upstanding clamp jaws 84 rigid therewith having opposing arcuate notches 85 in coaxial alignment with the inserting needle 65 and the aperture **66*a* of tapered bushing 66 when the clamping jaws are closed under influence of the spring 82. When closed, the cotton roving 37 is gripped and held in the two notches 85 substantially simultaneously with the severing of the roving by the scissors 70 to produce each plugging length of roving 37*a*, FIG. 12**.

When the rod 66 and needle 65 move forwardly under influence of cam 67, the cams 77 also move forwardly relative to the followers 78 and enable the spring 82 to move the clamp jaws 84 to their closed roving clamping positions. When the rod 61 is retracted by the cam 57, the cams 77 act on the followers 78 to open the clamping jaws 84 against the force of spring 82 and release the roving 37.

OPERATION

The machine cycle, which is completed in approximately three seconds, is initiated by placing the rear end of a pipet 67 in the guiding and stabilizing bushing 66 and exerting slight axial pressure on the pipet. This moves the panel 23 slightly toward the end wall 21 against the biasing force of torsion spring 27 and allows the shank 54 to engage the actuator 51 of start-up switch 50 which is electrically connected with precision gear motor 29 conventionally to start the motor.

The motor, through the gearing 33, begins to rotate the drive shaft 31, and with it the grooved cam 57 and the roving feed wheel 36. After a sufficient length of the cotton roving has been fed, as determined by the size of the lobe 38, while the follower element 62 is in the portion 58 of the cam groove, the groove portion 59 begins to advance the rod 61 and needle 65 forwardly toward the pipet. As this movement occurs, the clamp jaws 84 are closed on the cotton roving and substantially simultaneously the roving is severed by the scissors 70 to produce the length **37*a*, FIG. 12, suitable for forming a plug 66*b*. FIG. 5**.

Substantially simultaneously with the clamping and severing of the roving 37 in the described manner, the needle 65, FIGS. 12 and 13, engages the severed length **37*a* and inserts it with a folding action into the adjacent mouth of the pipet 67 being held against the bushing 66 manually, thereby installing the cotton plug 66*b*, as shown in FIG. 5**.

The cam groove portion 60 then withdraws the needle 65 from the pipet, opening the scissors 70 and opening the clamping jaws 84. When the needle and rod 61 are fully retracted, the small cam 46 continues to rotate for 90° until the actuator 48 of cycle stop switch 49 enters the recess 47, thus ending the cycle of operation by stopping or turning off the gear motor 29. As explained, this motor contains a magnetic brake for precision stopping. The ready light 56 is extinguished at the end of the operating cycle indicating to the attendant that the plugged pipet 67 can be removed. The operating cycle is repeated by the placement of the next pipet manually against the bushing 66, as previously described.

The entire operating mechanism is simple, very compact, positive and precise. The machine is highly convenient to operate and plugs pipets rapidly and in a uniform manner. It is far less complex and has substantially fewer adjustments and maintenance requirements than the prior art machines for a similar purpose. The advantages of the invention should now be apparent to those skilled in the art.

It is to be understood that the form of the invention herewith shown and described is to be taken as a preferred example of the same, and that various changes in the shape, size and arrangement of parts may be resorted to, without departing from the spirit of the invention or scope of the subjoined claims.

We claim:

1. A self-contained electrically powered pipet plugging maching comprising a frame including an upright end wall and a horizontal base plate, a horizontally swingable panel member hingedly mounted on said end wall on a vertical hinge axis and being resiliently biased away from the end wall, an electrically operated gear motor attached to said base plate, a horizontal axis rotary drive shaft supported on and spaced above the base plate and being operatively connected with and driven by the gear motor, an intermittent vertical cotton roving feed means including a feed wheel having a circumferential feed lobe of predetermined length mounted on said drive shaft in the space between said end wall and said horizontally swingable panel member, said vertical cotton roving feed means additionally including a spring-urged idler wheel in said space in opposing relationship to the feed wheel and being biased toward the feed wheel, a reciprocatory horizontal rod supported on and spaced above said base plate and being in parallel spaced relationship to said rotary drive shaft and below said drive shaft, said reciprocatory rod including a forward end pipet plug inserting needle, a rotary grooved cam on said drive shaft and turning therewith, a horizontally guided follower element on said reciprocatory rod, another follower element on the reciprocatory rod engaging in and following the groove of said cam to effect axial advancement and retraction of said rod and needle horizontally, scissors for severing a vertical cotton roving in the space between said end wall and panel member and being supported on said frame in a horizontal plane parallel to the axes of said drive shaft and rod and being at an elevation between the drive shaft and rod, the scissors including rear end horizontally swingable scissor blade operating cam arm extensions, a pair of spaced upright axis cam pins carried by the reciprocatory rod and being engaged with said cam arm extensions to cause closing of the scissor blades horizontally in response to axial advancement of said rod and opening of the scissor blades horizontally responsive to retraction of said rod, roving clamp jaws in said space and being pivotally mounted on said frame for movement toward and away from each other in a horizontal plane parallel to the plane in which the scissor blades operate and being disposed below the scissor blades, a spring interconnecting the clamp jaws and biasing them toward each other in a clamping mode, another cam means on the reciprocatory rod and below the elevation of said cam pins, said another cam means comprising an element on the rod having rearwardly converging cam faces, coacting cam follower means on the pivoted clamp jaws comprising a pair of spaced cam follower rollers and engaging said another cam means whereby axial advancement of said rod allows said clamp jaws to move together horizontally in the clamping mode and retraction of said rod causes separation of the clamp jaws to thereby release the vertical cotton roving, a pipet positioning and stabilizing bushing on said panel member in coaxial alignment with said rod and needle, whereby the needle upon axial advancement can engage, fold and insert a severed length of cotton roving into a pipet held in engagement with said bushing, a cycle start-up switch on said end wall having an actuator engaged by an element on the panel member during movement of the latter toward the end wall under pressure of a pipet against said bushing, a cycle terminating switch on said end wall having an actuator, and a cycle terminating cam on the rotary drive shaft rearwardly of the cotton roving feed wheel and rearwardly of said end wall and adapted during rotation to engage the actuator of said cycle terminating switch, said cycle terminating switch being mounted on the rear face of said end wall near and above said drive shaft.

* * * * *